United States Patent [19]

Cooper, Jr.

[11] 4,159,564

[45] Jul. 3, 1979

[54] MANDREL FOR HYDRAULICALLY EXPANDING A TUBE INTO ENGAGEMENT WITH A TUBESHEET

[75] Inventor: Frank W. Cooper, Jr., Monroeville, Pa.

[73] Assignee: Westinghouse Electric Corp., Pittsburgh, Pa.

[21] Appl. No.: 896,532

[22] Filed: Apr. 14, 1978

[51] Int. Cl.[2] ..... B23P 15/26

[52] U.S. Cl. ..... 29/727; 33/302; 72/21; 73/49.8

[58] Field of Search ..... 72/21; 29/727; 33/302, 33/125 B, DIG. 1; 73/49.8

[56] References Cited

U.S. PATENT DOCUMENTS

| | | | |
|---|---|---|---|
| 2,460,580 | 2/1949 | Huber | 29/727 |
| 2,779,279 | 1/1957 | Maiwurm | 29/727 |
| 3,376,941 | 4/1968 | Fitch et al. | 33/302 |
| 3,705,506 | 12/1972 | Clavin et al. | 72/21 |
| 3,803,901 | 4/1974 | McConnell et al. | 73/49.8 |

*Primary Examiner*—Lowell A. Larson
*Attorney, Agent, or Firm*—F. J. Baehr, Jr.

[57] ABSTRACT

A mandrel for hydraulically expanding tubes into engagement with a tubesheet, the body of the mandrel being coated with an electrically isolating impermeable membrane and having an eddy current coil adjacent the leading end thereof, the tube into which the mandrel is placed and the body of the mandrel serving as leads for operating the eddy current coil in order to determine when the leading end of the mandrel is adjacent the inner edge of the tubesheet and a mandrel having a portion formed from wire rope so that the mandrel is flexible and can fit into a tube adjacent a hemispherical head.

18 Claims, 3 Drawing Figures

MANDREL FOR HYDRAULICALLY EXPANDING A TUBE INTO ENGAGEMENT WITH A TUBESHEET

BACKGROUND OF THE INVENTION

1. Field of the Invention

This invention relates to hydraulically expanding tubes in a tubesheet of a heat exchanger and more particularly, to such a mandrel with an eddy current probe for detecting the inner edge of the tubesheet and such mandrel with a flexible central portion so that the mandrel may be inserted into a tube adjacent a hemispherical head.

2. Description of the Prior Art

A hydraulic tube expander mandrel having a ramp on which an O-ring seal rides was described in an application filed by the assignee June 28, 1977 and assigned Ser. No. 810,817, now U.S. Pat. No. 4,125,937.

U.S. Pat. Nos. 3,977,068 and 3,979,810 describe a simple mandrel and method for hydraulically expanding tubes into engagement with a tubesheet. The use of such mandrel as described therein are not satisfactory as the O-ring seals have a very short life.

When expanding a tube hydraulically, the portion of the tube expanded must be within the tubesheet as the pressurized fluid utilized causes the tube to yield and if the tube is not backed up by the tubesheet, it will burst. When hydraulically expanding a tube in a very thick tubesheet clad with a non-corrosive material on at least one side, the thickness of the tubesheet varies so that obtaining expansion generally throughout the portion in which the tube and tubesheet are contiguous requires very accurate positioning of the mandrel. Since one of the reasons for full-length expansion of a tube in a tubesheet is to eliminate crevice corrosion adjacent the inner edge of the tubesheet, accurate positioning of the leading end of the mandrel is critical. Utilizing a stop on the trailing end of the mandrel does not provide sufficiently accurate positioning of the leading end of the hydraulic expander relative to the inner edge of the tubesheet.

SUMMARY OF THE INVENTION

In general, a mandrel for hydraulically expanding a tube into engagement with a hole in a tubesheet, when made in accordance with this invention, comprises a body portion covered with an electrically isolating impermeable membrane and having a leading and trailing end. The body portion has an elongated groove in each end thereof. An elastomer sealing member is disposed in each of the grooves. An elastomer back-up member is also disposed in each of the grooves outboard of the sealing member. The mandrel also comprises passages disposed in the trailing end for inducing pressurized fluid between the grooves, whereby the pressurized fluid is contained between the seals, the membrane, and the tube to hydraulically expand the tube into engagement with the tubesheet.

BRIEF DESCRIPTION OF THE DRAWINGS

The objects and advantages of this invention will become more apparent from reading the following detailed description in connection with the acompanying drawings, in which.

DESCRIPTION OF THE PREFERRED EMBODIMENTS

Figure 1:
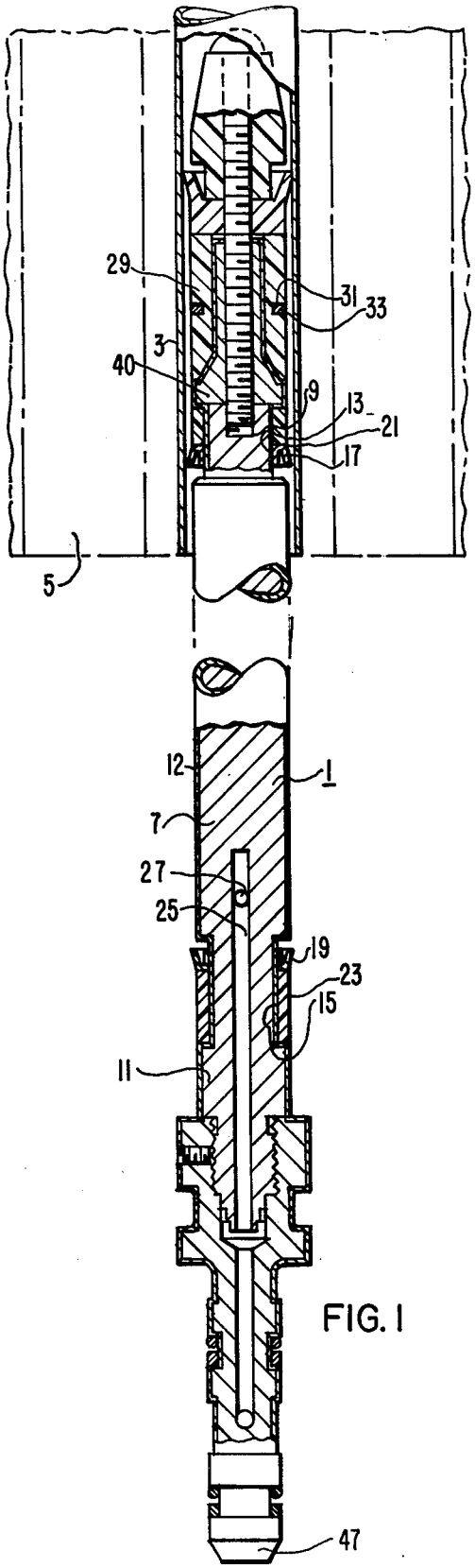
FIG. 1 is a partial sectional view of a mandrel for hydraulically expanding a tube, the mandrel is shown partially inserted into a tube in a tubesheet.

Referring now to the drawings in detail and in particular, to FIG. 1, there is shown a mandrel 1 for hydraulically expanding a tube 3 into engagement with a tubesheet 5 of a heat exchanger (not shown).

The mandrel 1 comprises a body portion 7 having a leading and a trailing end portion 9 and 11, respectively. The body portion 7 is coated or covered with an electrically isolating impermeable membrane 12 such as nylon or with some other electrically isolating material such as a ceramic.

Elongated grooves 13 and 15 are disposed adjacent the ends 9 and 11, respectively, of the body 7. Elastomer seal rings 17 and 19 having a C-shaped cross section or other sealing means such as O-rings are disposed on the inboard end of the grooves 13 and 15, respectively, so that the openings of the seals 17 and 19 face each other. Back-up rings 21 and 23 formed from a tough elastomer such as polyurethane are also disposed in the grooves 13 and 15, respectively, outboard of the C-shaped seal rings 17 and 19. The trailing end 11 of the body 7 has a centrally-disposed bore 25 and port 27 providing means for admitting pressurized fluid, demineralized water, to the area between the seal ring 17 and 19, the membrane 12 and the tube 3, whereby pressurized fluid is trapped in order to expand the tube into engagement with the tubesheet.

A plastic sleeve 29 is disposed on the leading end 9 of the body 7 outboard of the groove 13. The sleeve 29 is made of nylon or some other non-magnetic and non-conducting material. A circumferential groove 31 is disposed in the outer surface of the sleeve 29 and an eddy current coil 33 wound on a phenolic core with a stainless steel spacer ring is disposed in the groove 31.

Figure 3:
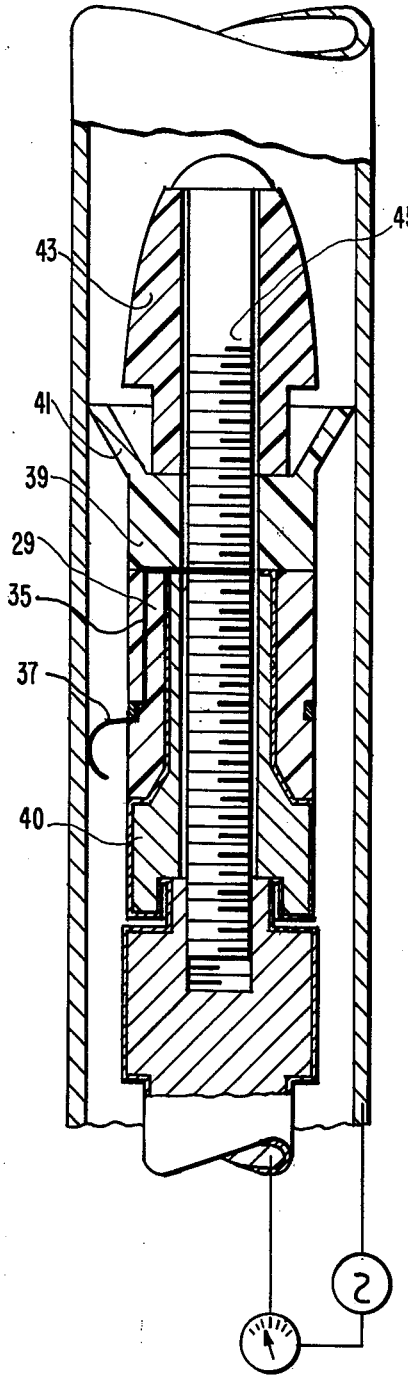
FIG. 3 is a partial sectional view of a mandrel showing the electrical circuitry of an eddy current coil disposed in the leading end of the mandrel.

As shown in FIG. 3, the coil has two leads 35 and 37. One of the leads 35 is electrically connected to the body 7. The other lead 37 forms a finger or contact which makes contact with the tube 3. A non-magnetic shield 40 made of austhentic stainless teel is disposed to support the sleeve 29 and to prevent the formation of an interfering field in the vicinity of the coil 33. An electrical signal having a frequency of approximately 10 KHz is applied to the coil and by monitoring the response to the signal an indication of the relationship between the inner edge of the tubesheet and the eddy current coil can be ascertained with a high degree of accuracy. So that when a predetermined response is indicated, pressurized fluid can be supplied via the port 27 to expand the portion of the tube contiguous with the tubesheet and adjacent the inner edge of the tubesheet.

A tube wiper 39 having a frustoconical portion 41 and made of a high-density polymer is disposed on the leading end 9 outboard of the sleeve 29 together with a bullet-shaped nose cone 43 made of a polymer such as nylon. Both the wiper 39 and the nose cone 43 are held in place by a brass machine screw 45 which is utilized to assure electrical contact between the body and the lead of the eddy current coil.

The trailing end 11 of the mandrel has a portion 47 which is not coated or covered by a membrane or an electrically isolating material and through which electrical contact is made to the one lead of the eddy current coil 33.

Figure 2:
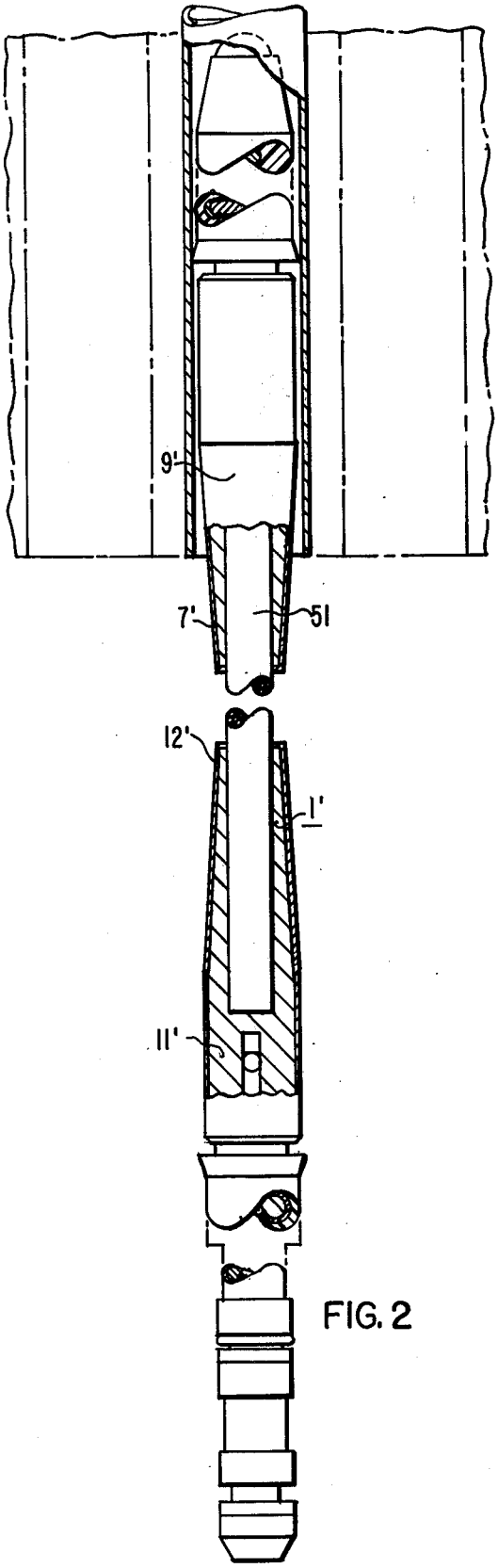
FIG. 2 is a partial sectional view of an alternate embodiment of a mandrel for hydraulically expanding a tube, the mandrel is shown partially inserted in a tube in a tubesheet.

As shown in FIG. 2, a mandrel 1' has a body 7' which comprises a counterwound stranded stainless steel cable or wire rope 51 disposed between end portions 9' and 11'. The end portions 9' and 11' are welded to the cable 51. An impermeable membrane 12', formed of a material such as nylon, is continuous over the end portions 9' and 11' and the cable 51 preventing the pressurized fluid from penetrating the cable 51. If the pressurized fluid penetrated the cable 51, the cable could not withstand the forces exerted on the end portions by the pressurized fluid. The flexible cable 51 allows the mandrel 1' to fit into a tube disposed adjacent an obstacle such as a hemispherical wall even though the mandrel 1' is very long.

The mandrels hereinbefore described may be utilized repeatedly to hydraulically expand tubes into engagement with the tubesheet and may be positioned very accurately with respect to the inner edge of the tubesheet resulting in the tubes being expanded into engagement with that portion of the tubesheet which is adjacent to the inner edge thereof.

I claim:

1. A mandrel for hydraulically expanding a tube into engagement with a hole in a tubesheet, said mandrel comprising:

a body portion covered with an electrically isolating material and having a leading and a trailing end;

said body portion having an elongated circumferential groove disposed in each of said ends;

an elastomer sealing member disposed in each of said grooves;

an elastomer back-up member disposed in each of said grooves outboard of said sealing members; and means disposed in said trailing end for introducing pressurized fluid between said grooves whereby the pressurized fluid hydraulically expands that portion of the tube between the seals into engagement with the tubesheet.

2. Apparatus as set forth in claim 1, wherein the body portion comprises a stranded cable disposed between the leading and trailing ends, the electrically isolating material is an impermeable membrane extending continuously over the ends and the cable, whereby the mandrel may be bent to fit into tubes adjacent an obstacle.

3. The apparatus as set forth in claim 1 and further comprising an eddy current coil disposed in the leading end of the body outboard of the back-up member, said eddy current coil being operable to indicate the position of the coil relative to the edge of the tubesheet.

4. The apparatus as set forth in claim 3, wherein the eddy current coil has two leads, one of which is electrically connected to the body of the mandrel and the other of which is electrically connected to the tube.

5. The apparatus as set forth in claim 4, wherein at least one finger is utilized to make electrical contact between one of the leads of the eddy current coil and the tube.

6. The apparatus as set forth in claim 3, wherein a non-magnetic sleeve is disposed over the leading end of the body outboard of the back-up member and the sleeve has a circumferential groove for receiving the eddy current coil.

7. The apparatus as set forth in claim 1, wherein the leading end of the body has an eddy current coil disposed therein outboard of the back-up ring.

8. The apparatus as set forth in claim 7 wherein the eddy current coil has two leads, one of which is electrically connected to the body of the mandrel and the other of which is electrically connected to the tube.

9. The apparatus as set forth in claim 8, wherein at least one finger is utilized to make electrical contact between one of the leads of the eddy current coil and the tube.

10. The apparatus as set forth in claim 7, wherein a non-magnetic sleeve is disposed over the leading end of the body outboard of the back-up ring and the sleeve has a circumferential groove for receiving the eddy current coil.

11. The apparatus as set forth in claim 1, wherein the seals have a C-shaped cross section.

12. The apparatus as set forth in claim 1, wherein the back-up ring is made of polyurethane.

13. The apparatus as set forth in claim 1, wherein the electrically isolating material is a ceramic.

14. The apparatus as set forth in claim 2, wherein the membrane is formed from nylon.

15. The apparatus as set forth in claim 2 wherein the end portions of the body are swaged on the cable and the membrane is continuous at the juncture of the members and the cable.

16. The apparatus as set forth in claim 2, wherein the cable is a counterwound stainless steel cable.

17. The apparatus as set forth in claim 1, wherein the seals are O-rings.

18. The apparatus as set forth in claim 3 and further comprising a shield disposed adjacent said coil.

* * * * *